US011330834B2

(12) United States Patent
Osuga et al.

(10) Patent No.: US 11,330,834 B2
(45) Date of Patent: May 17, 2022

(54) FLAVOR SOURCE MANUFACTURING METHOD

(71) Applicant: JAPAN TOBACCO INC., Tokyo (JP)

(72) Inventors: Shinya Osuga, Tokyo (JP); Kimitaka Uchii, Tokyo (JP); Takuma Nakano, Tokyo (JP); Morio Yajima, Tokyo (JP); Yusuke Nanasaki, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 505 days.

(21) Appl. No.: 16/165,279

(22) Filed: Oct. 19, 2018

(65) Prior Publication Data

US 2019/0045835 A1 Feb. 14, 2019

Related U.S. Application Data

(63) Continuation of application No. PCT/JP2017/015341, filed on Apr. 14, 2017.

(30) Foreign Application Priority Data

Apr. 22, 2016 (WO) ..... PCT/JP2016/062855

(51) Int. Cl.
*A24B 3/14* (2006.01)
*A24B 15/24* (2006.01)
(Continued)

(52) U.S. Cl.
CPC ..... *A24B 3/14* (2013.01); *A24B 3/12* (2013.01); *A24B 7/00* (2013.01); *A24B 15/12* (2013.01);
(Continued)

(58) Field of Classification Search
CPC ..... A24B 15/26; A24B 15/241; A24B 15/14
See application file for complete search history.

(56) References Cited

U.S. PATENT DOCUMENTS 5,765,570 A 6/1998 Litzinger et al.
6,109,272 A 8/2000 Saito et al.
(Continued)

FOREIGN PATENT DOCUMENTS

CN 104432472 A 3/2015
CN 105029669 A 11/2015
(Continued)

OTHER PUBLICATIONS

Office Action dated Apr. 15, 2020, in Korean Patent Application No. 10-2018-7032270.
(Continued)

*Primary Examiner* — Eric Yaary
*Assistant Examiner* — Jennifer A Kessie
(74) *Attorney, Agent, or Firm* — Birch, Stewart, Kolasch & Birch, LLP

(57) ABSTRACT

A method of manufacturing a flavor source includes: a step A of adding a basic substance to a tobacco raw material; a step B of heating the tobacco raw material added with the basic substance and releasing an inhaling flavor component into a vapor phase from the tobacco raw material; a step C of collecting the inhaling flavor component released into the vapor phase in the step B; a step D of washing a tobacco residue being the tobacco raw material obtained after the inhaling flavor component is released in the step B, with a washing solvent; a step E of pulverizing or cutting the tobacco residue obtained after being washed in the step D; and a step F of adding the inhaling flavor component collected in the step C to the tobacco residue obtained after pulverized or cut in the step E.

16 Claims, 8 Drawing Sheets

(51) Int. Cl.

| | |
|---|---|
| ***A24B 15/12*** | (2006.01) |
| ***A24B 3/12*** | (2006.01) |
| ***A24B 7/00*** | (2006.01) |
| ***A24B 15/14*** | (2006.01) |
| ***A24B 15/26*** | (2006.01) |
| ***A24B 15/28*** | (2006.01) |

(52) U.S. Cl.

CPC ..... *A24B 15/14* (2013.01); *A24B 15/241* (2013.01); *A24B 15/26* (2013.01); *A24B 15/287* (2013.01)

(56) References Cited

U.S. PATENT DOCUMENTS

| | | | | |
|---|---|---|---|---|
| 2007/0193596 | A1 | 8/2007 | Mori et al. | |
| 2010/0158840 | A1 | 6/2010 | Hiramoto et al. | |
| 2013/0160780 | A1 | 6/2013 | Matsumoto et al. | |
| 2013/0206153 | A1* | 8/2013 | Beeson | A24B 15/24 131/297 |
| 2016/0073678 | A1 | 3/2016 | Fujisawa et al. | |
| 2016/0360779 | A1 | 12/2016 | Fujisawa et al. | |
| 2016/0360781 | A1 | 12/2016 | Fujisawa et al. | |
| 2017/0320402 | A1 | 11/2017 | Konishi et al. | |

FOREIGN PATENT DOCUMENTS

| | | | | |
|---|---|---|---|---|
| EP | 2 923 587 | A1 | 9/2015 | |
| EP | 3097793 | A1 * | 11/2016 | A24B 15/26 |
| JP | H11-113552 | A | 4/1999 | |
| KR | 10-2008-0107425 | A | 12/2008 | |
| KR | 10-2013-0021470 | A | 3/2013 | |
| RU | 2 380 992 | C1 | 2/2010 | |
| WO | WO 2006/046517 | A1 | 5/2006 | |
| WO | WO 2013/060827 | A1 | 5/2013 | |
| WO | WO 2014/175399 | A1 | 10/2014 | |
| WO | WO 2015/129098 | A1 | 9/2015 | |
| WO | WO 2015/129680 | A1 | 9/2015 | |
| WO | WO-2015129098 | A1 * | 9/2015 | A24B 15/32 |
| WO | WO 2016/063775 | A1 | 4/2016 | |
| WO | WO 2015/057178 | A1 | 4/2021 | |

OTHER PUBLICATIONS

Extended European Search Report, dated Nov. 7, 2019, for European Application No. 17785927.9.

Office Action dated Jul. 16, 2020, in Eurasian Patent Application No. 201892398/28.

International Search Report for PCT/JP2017/015341 (PCT/ISA/210) dated May 23, 2017.

Written Opinion of the International Searching Authority for PCT/JP2017/015341 (PCT/ISA/237) dated May 23, 2017.

Office Action dated Mar. 31, 2021, in Eurasian Patent Application No. 201892398.

* cited by examiner

FIG. 6

| | INHALING FLAVOR COMPONENT RESIDUAL RATIO [–] | LEVULINIC ACID RESIDUAL RATIO | A/N RATIO |
|---|---|---|---|
| SAMPLE 21 | 0.554 | — | 0 |
| SAMPLE 22 | 0.757 | 0.96 | 0.53 |
| SAMPLE 23 | 0.884 | 0.66 | 1.16 |
| SAMPLE 24 | 0.895 | 0.47 | 3.52 |

FIG.9

| | LEVULINIC ACID RESIDUAL RATIO [−] | ADDITIVE | A/N RATIO |
|---|---|---|---|
| SAMPLE 41 | 0.882 | WATER (10% BY WEIGHT) | 2.99 |
| SAMPLE 42 | 0.598 | — | 2.98 |
| SAMPLE 43 | 0.943 | WATER (10% BY WEIGHT) | 1.56 |
| SAMPLE 44 | 0.629 | — | 1.62 |

FLAVOR SOURCE MANUFACTURING METHOD

CROSS REFERENCE TO RELATED APPLICATIONS

This application is a Continuation of PCT International Application No. PCT/JP2017/015341, filed on Apr. 14, 2017, which claims priority under 35 U.S.C. 119(a) to Patent Application No. PCT/JP2016/062855, filed in Japan on Apr. 22, 2016, all of which are hereby expressly incorporated by reference into the present application.

TECHNICAL FIELD

The present invention relates to a method of manufacturing a flavor source containing an inhaling flavor component.

BACKGROUND ART

Conventionally, as a technique of containing an inhaling flavor component into a member used as a flavor source, known is a technique of releasing an inhaling flavor component from a tobacco raw material and adding the released inhaling flavor component to the member used as the flavor source. For example, a trap solution being a trap solvent with a trapped inhaling flavor component is added to a tobacco residue obtained after the inhaling flavor component is released.

PRIOR ART DOCUMENT

Patent Document

Patent Document 1: WO2014/175399
Patent Document 2: WO2015/129098

SUMMARY OF THE INVENTION

A first characteristic is a manufacturing method, and a gist thereof is to include: a step A of adding a basic substance to a tobacco raw material; a step B of heating the tobacco raw material added with the basic substance and releasing an inhaling flavor component into a vapor phase from the tobacco raw material; a step C of collecting the inhaling flavor component released into the vapor phase in the step B; a step D of washing a tobacco residue being the tobacco raw material obtained after the inhaling flavor component is released in the step B, with a washing solvent; a step E of pulverizing or cutting the tobacco residue obtained after being washed in the step D; and a step F of adding the inhaling flavor component collected in the step C to the tobacco residue obtained after being pulverized or cut in the step E.

A gist of a second characteristic is that in the first characteristic, the step E is a step of pulverizing the tobacco residue obtained after being washed in the step D to a particle size of 1 mm or less.

A gist of a third characteristic is that in the first characteristic, the step E is a step of cutting the tobacco residue obtained after being washed in the step D to a cut size of 2 mm or less.

A gist of a fourth characteristic is that in any one of the first characteristic to the third characteristic, the step D is a step of supplying the washing solvent to the tobacco residue and extracting, together with the washing solvent, a soluble component released into the washing solvent from the tobacco residue.

A gist of a fifth characteristic is that in the fourth characteristic, the step D is repeated at least twice or more.

A gist of a sixth characteristic is that in the fifth characteristic, the step D is repeated at least twice or more by using the washing solvents having temperatures different from each other.

A gist of a seventh characteristic is that in the sixth characteristic, the step D includes a step of performing bubbling while adding $CO_2$ gas to the washing solvent having a lowest temperature or the washing solvent having a temperature of 20° C. or less, from among the washing solvents having temperatures different from each other.

A gist of an eighth characteristic is that in the manufacturing method in any one of the first characteristic to the seventh characteristic, the step D includes: a step of extracting the soluble component by using water having a first temperature as the washing solvent; and a step of extracting the soluble component by using water having a second temperature lower than the first temperature as the washing solvent and performing bubbling while adding $CO_2$ gas to the water having the second temperature.

A gist of a ninth characteristic is that in any one of the first characteristic to the eighth characteristic, before the step D, the particle size of the tobacco residue is larger than 1 mm.

A gist of a tenth characteristic is that in any one of the first characteristic to the ninth characteristic, the step C is a step of collecting, as a liquid phase, the inhaling flavor component released into the vapor phase in the step B.

A gist of an eleventh characteristic is that in any one of the first characteristic to the tenth characteristic, the step C includes a step of condensing the inhaling flavor component released into the vapor phase in the step B.

A gist of a twelfth characteristic is that in any one of the first characteristic to the tenth characteristic, the step C includes a step of trapping the inhaling flavor component released into the vapor phase in the step B, by a trap solvent.

A gist of a thirteenth characteristic is that in any one of the tenth characteristic to the twelfth characteristic, the manufacturing method includes at least one of: a step G1 of adding an acidic substance to an inhaling flavor solution containing the inhaling flavor component collected in the step C; and a step G2 of adding an acidic substance to the tobacco residue obtained after being washed in the step D.

A gist of a fourteenth characteristic is that in the thirteenth characteristic, the step G2 is performed after the step E.

A gist of a fifteenth characteristic is that in the thirteenth characteristic or the fourteenth characteristic, a ratio of a molar amount of the acidic substance relative to a molar amount of the inhaling flavor component collected in the step C is 1.0 or more.

A gist of a sixteenth characteristic is that in any one of the tenth characteristic to the fifteenth characteristic, the manufacturing method includes: a step of adding a polyol or an alcohol to at least one of a trap solvent for trapping the inhaling flavor component, an inhaling flavor solution containing the inhaling flavor component collected in the step C, and the tobacco residue.

A gist of a seventeenth characteristic is that in any one of the twelfth characteristic and the thirteenth characteristic to the fifteenth characteristic reciting the twelfth characteristic, in the step C, as the trap solvent, a solvent containing a polyol or an alcohol is used.

A gist of an eighteenth characteristic is that in any one of the fifteenth characteristic to the seventeenth characteristic, the manufacturing method includes: a step H1 of adding water so that the tobacco residue contains 10 wt % or more of water, where a total weight of a predetermined substance contained in the tobacco residue obtained after the inhaling flavor component is added in the step F is 100 wt %, in which the predetermined substance is a mixture of the acidic substance, a polyol, and water, a mixture of the acidic substance, an alcohol, and water, or a mixture of the acidic substance, a polyol, an alcohol, and water.

A gist of a nineteenth characteristic is that in any one of the fifteenth characteristic to the seventeenth characteristic, the manufacturing method includes: a step H2 of adding water so that the inhaling flavor solution contains 10 wt % or more of water, where before being added to the tobacco residue in the step F, a total weight of a predetermined substance contained in the inhaling flavor solution containing the inhaling flavor component collected in the step C is 100 wt %, in which the predetermined substance is a mixture of the acidic substance, a polyol, and water, a mixture of the acidic substance, an alcohol, and water, or a mixture of the acidic substance, a polyol, an alcohol, and water.

A gist of a twentieth characteristic is that in any one of the tenth characteristic to the nineteenth characteristic, the manufacturing method includes: a step I1 of adding a binder to an inhaling flavor solution containing the inhaling flavor component collected in the step C; or a step I2 of adding a binder to the tobacco residue obtained after being washed in the step D.

A gist of a twenty-first characteristic is that in the twentieth characteristic, the manufacturing method includes: a step J of forming the tobacco residue after the step F and addition of the binder.

A gist of a twenty-second characteristic is that in the twenty-first characteristic, the tobacco residue formed in the step J comprises a plurality of granular bodies.

A gist of a twenty-third characteristic is that in any one of the first characteristic to the twenty-second characteristic, at least one of the step A and the step B includes a step of adding water to the tobacco raw material.

In any of the characteristics described above, the step D of washing the tobacco residue with a washing solvent includes a step of extracting the washing solvent via a filter or a mesh.

BRIEF DESCRIPTION OF THE DRAWINGS

FIG. 6 is a diagram for explaining a first experiment.

FIG. 9 is a diagram for explaining a second experiment.

DESCRIPTION OF THE EMBODIMENT

Figure 1:
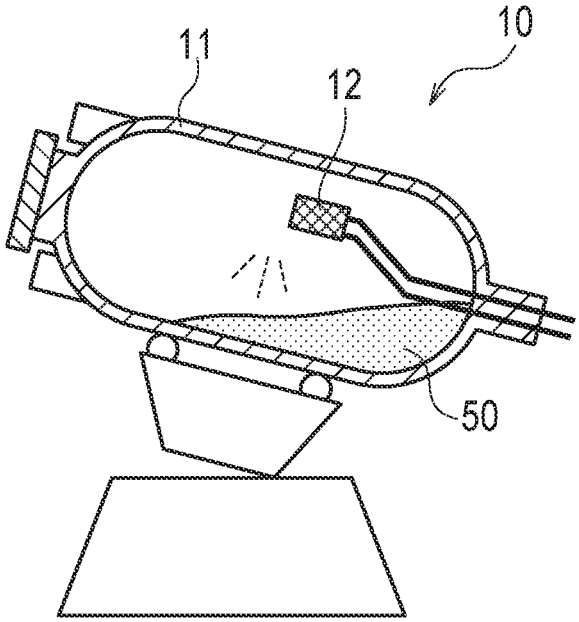
FIG. 1 is a diagram illustrating an example of a manufacturing device according to an embodiment.

An embodiment of the present invention will be described, below. It is noted that, in the following description of the drawings, identical or like numerals and symbols are assigned to identical or like parts. However, it should be noted that the drawings are schematically shown and the ratio and the like of each dimension may be different from the real ones.

Therefore, the specific dimensions and the like should be determined in view of the below explanation. Further, it is needless to say that relations and ratios among the respective dimensions may differ among the drawings.

OVERVIEW OF DISCLOSURE

The inventor, et. al., examined an aspect of manufacturing a flavor source according to the following steps. Specifically, a manufacturing method includes: a step A of adding a basic substance to a tobacco raw material; a step B of heating the tobacco raw material added with the basic substance and releasing an inhaling flavor component into a vapor phase from the tobacco raw material; a step C of trapping the inhaling flavor component released into the vapor phase in the step B, by a trap solvent; and a step D of washing a tobacco residue being the tobacco raw material obtained after the inhaling flavor component is released in the step B, with a washing solvent. As a result of research on such a manufacturing method, the inventors, et. al., found that it was difficult to balance improving a yield of the tobacco residue with suppressing unevenness in a distribution of the trap solution in the tobacco residue. As a result of intensive studies on the factors, the inventors, et. al., have found that if the size of the tobacco raw material (tobacco residue) is large, a decrease in the yield of the tobacco residue in the washing step is suppressed, but unevenness occurs in the distribution of the trap solution in the tobacco residue obtained after the trap solution is added, and if the size of tobacco raw material (tobacco residue) is small, it is less likely that unevenness occurs in the distribution of the trap solution in the tobacco residue obtained after the trap solution is added, but the yield of the tobacco residue in the washing step is decreased.

A manufacturing method according to the overview of the disclosure has been made to solve the above-mentioned problems. Specifically, a manufacturing method according to the overview of the disclosure includes: a step A of adding a basic substance to a tobacco raw material; a step B of heating the tobacco raw material added with the basic substance and releasing an inhaling flavor component into a vapor phase from the tobacco raw material; a step C of collecting the inhaling flavor component released into the vapor phase in the step B; a step D of washing a tobacco residue being the tobacco raw material obtained after the inhaling flavor component is released in the step B, with a washing solvent; a step E of pulverizing or cutting the tobacco residue obtained after being washed in the step D; and a step F of adding the inhaling flavor component collected in the step C to the tobacco residue obtained after pulverized or cut in the step E.

According to the manufacturing method according to the overview of the disclosure, the step D of washing the tobacco residue with the washing solvent is performed before the step E of pulverizing or cutting the tobacco residue. In other words, since the size of the tobacco residue in the step D is relatively large, and thus, the decrease in yield of the tobacco residue in the step D is suppressed. On the other hand, after the step E of pulverizing or cutting the tobacco residue, the step F of adding the trap solution to the tobacco residue is performed. That is, since the size of the tobacco residue in the step F is relatively small, it is possible to uniformly distribute the inhaling flavor component on the surface of the tobacco residue.

Embodiment (Manufacturing Device)

Figure 2:
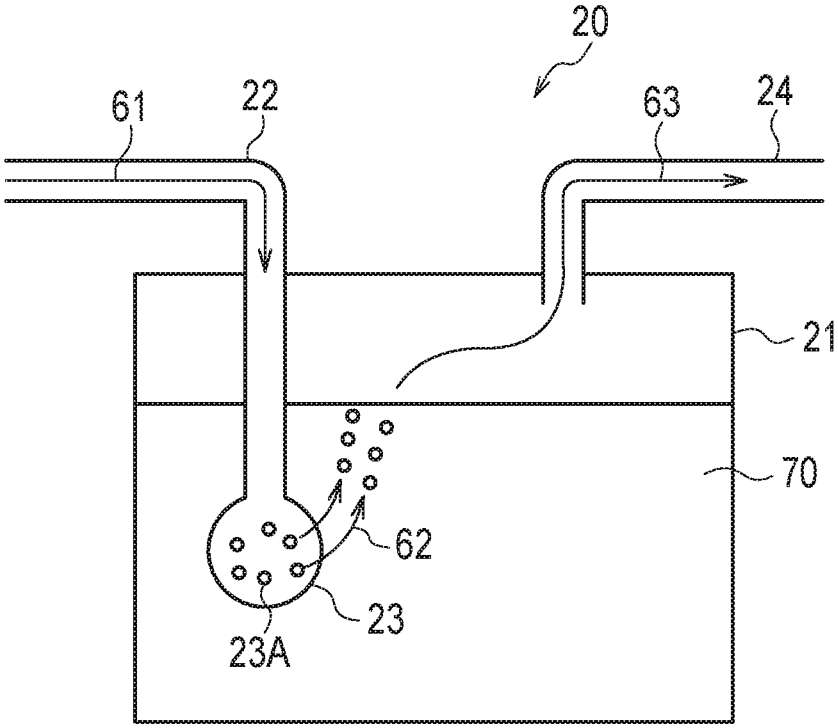
FIG. 2 is a diagram illustrating an example of the manufacturing device according to the embodiment.

A manufacturing device according to an embodiment will be described, below. FIG. 1 and FIG. 2 are diagrams each illustrating an example of the manufacturing device according to the embodiment.

Firstly, one example of a treatment device 10 will be described with reference to FIG. 1. The treatment device 10 includes a container 11 and an atomizer 12.

The container 11 contains a tobacco raw material 50. The container 11 is constituted, for example, of a member having heat resistance and pressure resistance (for example, steel used stainless (SUS)). The tobacco raw material 50 may be composed of cut or powder and granular tobacco raw material. At this stage, a particle size of the tobacco raw material 50 is at least 1 mm or greater. The particle size of the tobacco raw material 50 is preferably 3 mm or more, and more preferably 5 mm or more.

The atomizer 12 adds a basic substance to the tobacco raw material 50. As the basic substance, it is preferable to use, for example, a basic substance such as a potassium carbonate aqueous solution.

Here, it is preferable that the atomizer 12 adds the basic substance to the tobacco raw material 50 until pH of the aqueous solution obtained by adding 10 times by weight ratio water to the tobacco raw material 50 is 8.0 or more. Here, more preferably, the atomizer 12 adds the basic substance to the tobacco raw material 50 until pH of the aqueous solution obtained by adding 10 times by weight ratio water to the tobacco raw material 50 is in the range of 8.9 to 9.7. Moreover, for efficient release of the inhaling flavor component into a vapor phase from the tobacco raw material 50, a water content in the tobacco raw material 50 obtained after being misted with the basic substance is preferably 10 wt % or more, and more preferably 30 wt % or more. There is no particular limit as to the upper limit of the water content in the tobacco raw material 50; however, it is preferably 50 wt % or less, in order to efficiently heat the tobacco raw material 50, for example.

An initial contained amount of the inhaling flavor component (in this case, a nicotine component) contained in the tobacco raw material 50, in the dry state, is preferably 2.0 wt % or more, where the total weight of the tobacco raw material 50 is 100 wt %. More preferably, the initial contained amount of the inhaling flavor component (in this case, the nicotine component) is 4.0 wt % or more.

A *Nicotiana* raw material such as *Nicotiana. tabacum* or *Nicotiana. rusutica* may be used as the tobacco raw material 50. Varieties such as Burley and flue-cured type may be used as the *Nicotiana. tabacum*. Note that varieties besides Burley and flue-cured type may also be used as the tobacco raw material 50.

Secondly, an example of a trap device 20 will be described with reference to FIG. 2. The trap device 20 includes a container 21, a pipe 22, a release portion 23, and a pipe 24.

The container 21 houses a trap solvent 70. The container 21 is composed of a member resistant to the trap solvent and to a volatile inhaling flavor component or a volatile impurity (for example, glass or stainless steel (SUS)). It is preferable that the container 21 constitutes a space airtight to the extent that it is possible to minimize movement of air to outside the space.

The temperature of the trap solvent 70 is ordinary temperature, for example. Here, the lower limit of the ordinary temperature is, for example, a temperature at which the trap solvent 70 does not solidify, preferably 10° C. The upper limit of the ordinary temperature is 40° C. or less. By setting the temperature of the trap solvent 70 to 10° C. or more to 40° C. or less, it is possible to efficiently remove volatile impurity component, such as ammonium ions or pyridine, from the trap solvent 70 in which the inhaling flavor component is trapped while suppressing the volatilization of the inhaling flavor component from the trap solution 70 in which the inhaling flavor component is trapped. Glycerol, water, or ethanol can be used as the trap solvent 70, for example. The trap solvent 70 may be composed of a plurality of kinds of solvents. In order to increase the trap efficiency of the inhaling flavor component, it is preferable that the initial pH of the trap solvent 70 is lower than the pH of the aqueous solution obtained by adding 10 times by weight ratio water to the tobacco raw material 50 added with the basic substance. In order to bring the temperature of the trap solvent 70 to 10° C. or more to 40° C. or less, the temperature of the container 21 may be chilled to a temperature below ordinary temperature (for example, 5° C.).

The pipe 22 guides a released component 61, which has been released into a vapor phase from the tobacco raw material 50 through heating of the tobacco raw material 50, to the trap solvent 70. The released component 61 contains at least a nicotine component being an indicator of the inhaling flavor component. Since the basic substance is added to the tobacco raw material 50, the released component 61 may contain ammonium ions, depending on an elapsed time (processing time) from a start of a trap treatment of the inhaling flavor component. The released component 61 may contain TSNA, depending on the elapsed time (processing time) from the start of the trap treatment.

The release portion 23 is provided at a distal end of the pipe 22, and is submerged in the trap solvent 70. The release portion 23 includes a plurality of openings 23A. The released component 61 guided by the pipe 22 is released as a bubbled released component 62 into the trap solvent 70 from the plurality of openings 23A.

The pipe 24 guides a residual component 63, which has not been trapped by the trap solvent 70, out from the container 21.

Here, because the released component 62 is a component released into a vapor phase by heating the tobacco raw material 50, it is likely that the temperature of trap solvent 70 will rise due to the released component 62. Accordingly, the trap device 20 may have a function for chilling the trap solvent 70 in order to maintain the temperature of the trap solvent 70 at the ordinary temperature.

The trap device 20 may have a Raschig ring in order to increase a contact area of the released component 62 relative to the trap solvent 70.

In the embodiment, the tobacco residue being the tobacco raw material 50 obtained after the inhaling flavor component has been released, is washed with a washing solvent. The washed tobacco residue is pulverized by a pulverizer or is cut by a cutting machine. A trap solution (that is, an inhaling flavor solution containing the inhaling flavor component) being the trap solvent 70 in which the inhaling flavor component is trapped is added to the tobacco residue that has been pulverized or cut. These processes will be described in detail later (see FIG. 4).

Application Example

An application example of the tobacco residue containing the inhaling flavor component will be described, below. FIG.

3 is a diagram for explaining the application example of the tobacco residue containing the inhaling flavor component.

Figure 3:
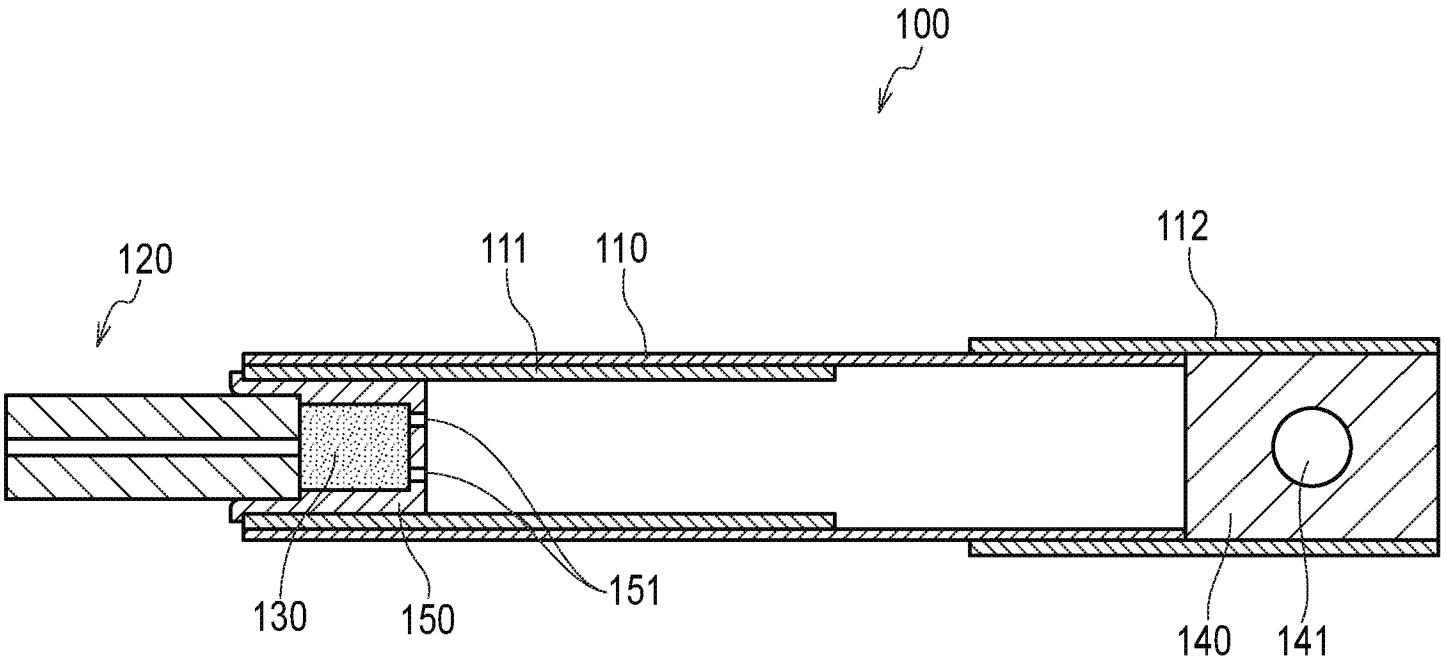
FIG. 3 is a diagram for explaining an application example of a tobacco residue containing an inhaling flavor component.

As illustrated in FIG. 3, a flavor inhaling tool 100 includes a holder 110, a carbon heat source 120, a flavor source 130, a filter 140, and a cup 150.

The holder 110 is, for example, a paper tube having a tubular shape. A cylindrical aluminum layer 111 is provided on an inner wall of the holder 110 to be in contact with the cup 150. The carbon heat source 120 generates heat to heat the flavor source 130. The flavor source 130 is a substance generating a flavor and is composed of a tobacco residue containing an inhaling flavor component. The filter 140 suppresses an impurity substance from being guided to a suction mouth side. The filter 140 includes a capsule 141 configured to contain a flavor substance such as menthol. Around an outer wall of the filter 140, a chip paper 112 is wound. The cup 150 holds the flavor source 130 such that the flavor source 130 is exposed to a side of the carbon heat source 120. On a bottom of the cup 150, an air hole 151 is provided. The air hole 151 is smaller than a particle size or a cut width of the tobacco residue constituting the flavor source 130 so that the tobacco residue constituting the flavor source 130 does not fall off.

(Manufacturing Method)

Figure 4:
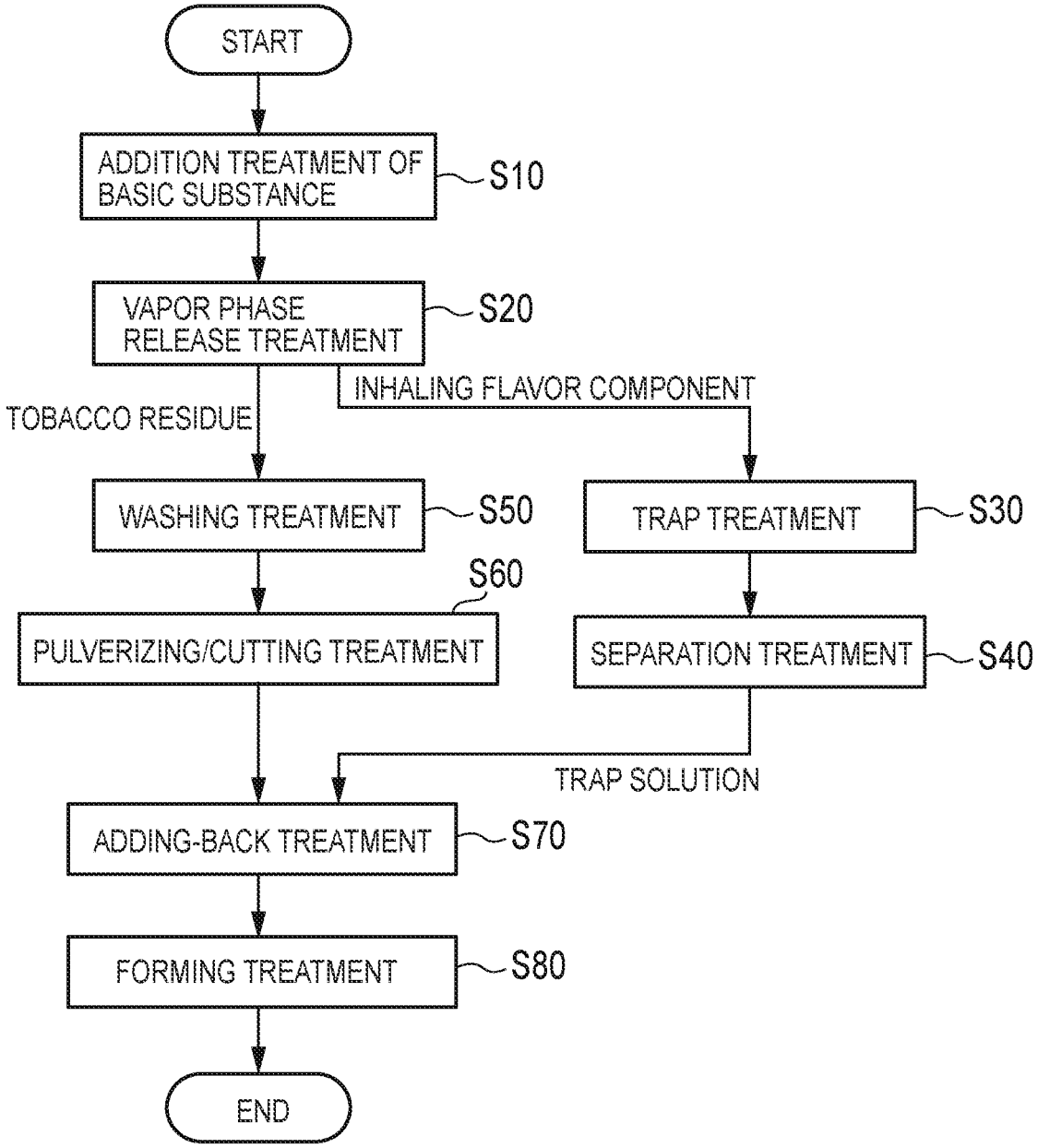
FIG. 4 is a flowchart illustrating a manufacturing method according to the embodiment.

A method of manufacturing a flavor source according to the embodiment will be described, below. FIG. 4 is a flowchart illustrating a manufacturing method according to the embodiment.

As illustrated in FIG. 4, in step S10 (that is, step A), a basic substance is added to the tobacco raw material 50, using the treatment device 10 mentioned previously. As the basic substance, it is possible to use, for example, a basic substance such as a potassium carbonate aqueous solution. The particle size of the tobacco raw material 50 is at least 1 mm or greater. The particle size of the tobacco raw material 50 is preferably 3 mm or more, and more preferably 5 mm or more. In the embodiment, the tobacco raw material 50 is subject to a pulverization treatment to have a particle size larger than 1 mm before step S50 described later.

An initial contained amount of the inhaling flavor component (in this case, a nicotine component) contained in the tobacco raw material 50, in the dry state, is preferably 2.0 wt % or more, where the total weight of the tobacco raw material 50 is 100 wt %. More preferably, the initial contained amount of the inhaling flavor component (in this case, the nicotine component) is 4.0 wt % or more.

As described above, the pH of the aqueous solution obtained by adding 10 times by weight ratio water to the tobacco raw material 50 added with the basic substance is preferably 8.0 or more. More preferably, the pH of the aqueous solution obtained by adding 10 times by weight ratio water to the tobacco raw material 50 added with the basic substance is preferably in the range of 8.9 to 9.7.

In step S20 (that is, step B), the tobacco raw material 50 added with the basic substance is heated, and the inhaling flavor component is released from the tobacco raw material 50 into the vapor phase. The inhaling flavor component released into the vapor phase is guided to the trap device 20 described above.

Here, the heating temperature of the tobacco raw material 50 is in the range from 80° C. or more to less than 150° C. When the heating temperature of the tobacco raw material 50 is 80° C. or more, it is possible to advance a timing at which a sufficient inhaling flavor component is released from the tobacco raw material 50. On the other hand, when the heating temperature of the tobacco raw material 50 is less than 150° C., it is possible to delay a timing at which the TSNA is released from the tobacco raw material 50.

Here, before the tobacco raw material 50 is heated, a treatment of subjecting the tobacco raw material 50 to a water-adding treatment may be performed. Such a water-adding treatment may be performed in step S10 or may be performed before heating the tobacco raw material 50 in step S20. Alternatively, the water-adding treatment may be performed while heating the tobacco raw material 50 in step S20 to compensate for a moisture decreasing with the heating of the tobacco raw material 50 in step S20. Also in such a case, the water-adding treatment may be performed intermittently at least once or more. Alternatively, the water-adding treatment may be performed continuously over a predetermined period of time. It is preferable that a water content of the tobacco raw material 50 before heating the tobacco raw material 50 is 30 wt % or more. There is no particular limit as to the upper limit of the water content in the tobacco raw material 50; however, it is preferably 50 wt % or less, in order to efficiently heat the tobacco raw material 50, for example.

In addition, it is preferable that step S20 includes a step of adding a nonaqueous solvent to the tobacco raw material 50. An amount of the nonaqueous solvent is preferably 10 wt % or more and 50 wt % or less with respect to the tobacco raw material 50. As a result, an impurity substance soluble in the nonaqueous solvent under the heating condition is transferred from the tobacco raw material 50, via the liquid phase, to the nonaqueous solvent, so that the impurity substance can be efficiently removed in step S50 described later (washing treatment). The nonaqueous solvent may be a solvent other than water. Specific examples of the nonaqueous solvent include glycerin, propylene glycol, ethanol, alcohol, acetonitrile, and hexane. Here, in the step of adding the nonaqueous solvent to the tobacco raw material 50, water may be added to the tobacco raw material 50 in addition to the nonaqueous solvent.

A timing of adding the nonaqueous solvent to the tobacco raw material 50 may be a timing until completion of step S20. For example, the timing of adding the nonaqueous solvent to the tobacco raw material 50 may be a timing between step S10 and step S20. Alternatively, the timing of adding the nonaqueous solvent to the tobacco raw material 50 may be a timing somewhere during step S20. Further, it is preferable that the nonaqueous solvent is a solvent substantially not vaporized at the heating temperature in step S20. As a result, in step S30 described later, the nonaqueous solvent and the impurity substance dissolved in the nonaqueous solvent can be suppressed from entering the trap solvent.

It is noted that in step S20, when the tobacco raw material 50 is being heated, the tobacco raw material 50 may be subjected to the water-adding treatment. It is preferable that the water content of the tobacco raw material 50 is kept at 10% or more and 50% or less by the water-adding treatment. Further, in step 20, the tobacco raw material 50 may be continuously added with water. The water addition amount is preferably adjusted so that the water content of the tobacco raw material 50 is 10% or more and 50% or less. Further, together with the water-adding treatment, the above-mentioned nonaqueous solvent may be added to the tobacco raw material 50.

Further, in step S20, it is preferable to subject the tobacco raw material 50 to an aeration treatment. This makes it possible to increase the amount of inhaling flavor component contained in the released component 61 released into the vapor phase from the tobacco raw material 50 added with the basic substance. In the aeration treatment, for example, saturated water vapor at 80° C. is brought into contact with the tobacco raw material 50. An aeration time in the aeration treatment differs depending on each device for treating the tobacco raw material 50 and each amount of the tobacco raw material 50, and thus, it is not possible to make generalization; however, for example, if the tobacco raw material 50 is 500 g, the aeration time is within 300 minutes or less. The total aeration amount in the aeration treatment also differs depending on the device for treating the tobacco raw material 50 and the amount of the tobacco raw material 50, and thus, it is not possible to make generalization; however, for example, if the tobacco raw material 50 is 500 g, the total aeration amount is about 10 L/g.

The air used in the aeration treatment need not necessarily be a saturated water vapor. The water content in the air used in the aeration treatment does not particularly need to humidify the tobacco raw material 50, and for example, the water contained in the tobacco raw material 50 to which the heating treatment and the aeration treatment are applied may be adjusted to stay in a range of less than 50%. The gas used in the aeration treatment is not limited to air, and it may be an inert gas such as nitrogen or argon.

In step S30 (that is, in step C), the inhaling flavor component released into the vapor phase in step S20 is trapped by the trap solvent 70 by using the trap device 20 described above. In other words, step S30 is a step of collecting, as a liquid phase, the inhaling flavor component released into the vapor phase in step S20.

It should be noted that for convenience, step S20 and step S30 in FIG. 4 are described as if these steps are performed separately, but step S20 and step S30 are performed in parallel. It should be noted that parallel means that a period during which step S30 is performed overlaps with a period during which step S20 is performed, and it is not necessary that step S20 and step S30 are started and ended at the same time.

Here, in step S20 and step S30, a pressure inside the container 11 of the treatment device 10 is equal to or less than ordinary pressure. In particular, the upper limit of the pressure inside the container 11 of the treatment device 10 is +0.1 MPa or less in terms of a gauge pressure. Further, the interior of the container 11 of the treatment device 10 may be a reduced pressure atmosphere.

Here, water, glycerol, or ethanol can be used as the trap solvent 70, for example, as described above. The temperature of the trap solvent 70 is ordinary temperature, as described above. Here, the lower limit of the ordinary temperature is, for example, a temperature at which the trap solvent 70 does not solidify, preferably 10° C. The upper limit of the ordinary temperature is 40° C. or less.

In step S40, in order to separate the inhaling flavor component contained in the trap solution, the trap solution for trapping the inhaling flavor component is subjected to a vacuum concentration treatment, a heat concentration treatment or a salting-out treatment. However, it should be noted that the treatment of step S40 is not essential and may be omitted.

Here, it is preferable that the vacuum concentration treatment is performed in a space airtight to the extent that it is possible to minimize movement of air to outside the space. As a result, there is little air contact and there is no need to keep the trap solvent 70 at high temperature, and thus, it is less likely that the component changes. Therefore, if the reduced pressure concentration is used, types of available trap solvents is increased.

In the heat concentration treatment, although there is a concern in degeneration of a liquid such as oxidization of the inhaling flavor component, it may be possible to obtain an effect of increasing a flavor. However, compared to vacuum concentration, types of available trap solvents are reduced. For example, there is a possibility that a trap solvent having an ester structure such as MCT (Medium Chain Triglyceride) can not be used.

In the salting-out treatment, it is possible to increase the separation accuracy of the inhaling flavor component as compared to the vacuum concentration treatment; however, a yield of the inhaling flavor component is poor because the inhaling flavor component is half in each liquid solvent phase/water phase. Further, coexistence of a hydrophobic substance (such as MCT) is assumed to be required, and thus, salting-out may not occur depending on a ratio among the trap solvent, the water, and the inhaling flavor component.

In step S50 (that is, step D), the tobacco residue being the tobacco raw material 50 obtained after the inhaling flavor component has been released in step S20 is washed with a washing solvent. For example, a washing solvent is supplied to the tobacco residue, and a soluble component released from the tobacco residue into the washing solvent is extracted together with the washing solvent. As a result, an impurity substance (soluble component) remaining in the tobacco residue can be easily removed from the tobacco raw material 50 (tobacco residue). It should be noted that before step S50, the pulverization treatment of step S10 and the vapor phase release treatment of step S20 are performed so that the particle size of the tobacco residue is larger than at least 1 mm.

Here, step S50 involves a step of extracting the washing solvent. In the extraction step, the washing solvent may be extracted through a filter, a mesh or the like so that the tobacco residue does not fall out when extracting the washing solvent; however, in such a case and as well as if the particle size of the tobacco residue is small in step S50, it is more likely that some tobacco residue loss may occur such as the tobacco residue falling off with the washing solvent. Further, when transferring the tobacco residue from the washing device to the pulverizing device (cutting device), it is probable that a loss occurs such as the fine powder in the washing device can not be completely collected. In addition, the tobacco residue may be caught by a filter, a mesh, or the like, and a processing time of the step D may be prolonged due to clogging. Thus, if the particle size of the tobacco residue is small in step S50, the yield of tobacco residue may decrease. On the other hand, in the embodiment, by introducing step S60 of pulverizing or cutting the tobacco residue after being washed in step S50, a tobacco residue with a relatively large particle size can be processed in step S50, and thus, it is possible to suppress a decrease in yield of the tobacco residue.

As the washing solvent used in step S50, an aqueous solvent can be mentioned. Specific examples of the aqueous solvent may be pure water, ultrapure water, or city water. The temperature of the washing solvent may be ordinary temperature (for example, 20° C.±15° C.) to 70° C. When the aqueous solvent is used as the washing solvent, a solvent in which $CO_2$ gas is bubbled may be used as the water-soluble solvent. Specifically, an aqueous solution containing carbonated water or a supersaturated $CO_2$ gas may be used as the water-soluble solvent. Further, a solvent in which ozone is bubbled may be used as the aqueous solvent (for example, water).

Step S50 may be repeated at least twice or more. In such a case, step S50 may be repeated at least twice or more by using washing solvents having temperatures different from each other. In such a case, step S50 may include a step of performing bubbling while adding the $CO_2$ gas to the washing solvent having the lowest temperature out of temperatures different from each other. Step S50 may include a step of performing bubbling while adding the $CO_2$ gas to the washing solvent having a temperature of 20° C. or lower. As described above, by performing bubbling while adding the $CO_2$ gas to the washing solvent having a relatively low temperature, a basic substance (potassium carbonate aqueous solution or the like) added to the tobacco raw material 50 can be efficiently neutralized and removed while suppressing a decrease in the solubility of $CO_2$ gas.

For example, step S50 may include a step of extracting a soluble component by using water having a first temperature (for example, 40 to 80° C.) as the washing solvent (hereinafter, referred to as a first washing step), and a step of extracting the soluble component by using water having a second temperature (for example, 10 to 15° C.) lower than the first temperature and performing bubbling while adding the $CO_2$ gas to the water having the second temperature (hereinafter, referred to as a second washing step). As a result, with the first washing step using the water having the relatively high first temperature, a water-soluble impurity is removed, and with the second washing step of performing bubbling while adding the $CO_2$ gas to the water having the relatively low second temperature, it is possible to efficiently neutralize and remove the basic substance (such as potassium carbonate aqueous solution or the like) added to the tobacco raw material 50 while suppressing a decrease in the solubility of $CO_2$ gas. The second washing step is preferably performed after the first washing step. The first washing step may be performed twice or more. The second washing step may be performed twice or more.

As the washing solvent, a nonaqueous solvent such as propylene glycol, glycerin, ethanol, MCT, hexane, methanol, and acetonitrile can be used in addition to the above-mentioned aqueous solvent. It is also possible to mix these nonaqueous solvents with the above-mentioned aqueous solvent to be used.

Instead of the above-described bubbling using the $CO_2$ gas, an acidic solvent may be used as the washing solvent. Examples of the acidic solvent can include a solvent including carboxylic acid such as acetic acid or malic acid.

Further, if n is an integer of 1 or more, a solvent A may be used as the washing solvent in an n-th step, and a solvent B different from the solvent A may be used as the washing solvent in an n+1-th step. Note that if step S50 is repeated three times or more, three or more types of solvents may be used as the washing solvent. Further, when step S50 is repeated three or more times, the same solvent may be used in twice or more steps S50.

The tobacco residue obtained after washing with the washing solvent may be subjected to a drying treatment. A drying condition can include a mode in which air is circulated at a temperature of about 110 to 125° C. (ventilation volume is 10 to 20 L/min/250 g-minute) for about 100 to 150 minutes.

As described above, if step S50 is repeated two or more times, by properly selecting the type of washing solvent used in each washing treatment, it is possible to differ a type of impurity component having high affinity with the washing solvent, and thus various types of impurity components can be removed.

In step S60 (that is, step E), the tobacco residue obtained after being washed in step S50 is pulverized or cut.

Specifically, step S60 may be a step of pulverizing the tobacco residue obtained after being washed in step S50 to a particle size of 1 mm or less by a pulverizer. Step S60 is preferably a step of pulverizing the tobacco residue to a particle size of 0.71 mm or less, more preferably a step of pulverizing the tobacco residue to a particle size of 0.5 mm or less. Further, it is preferable that step S60 is a step of pulverizing the tobacco residue to a particle size of 0.212 mm or less. The particle size of the tobacco residue is obtained, for example, by sieving that complies with JIS Z 8815 by using a stainless sieve that complies with JIS Z 8801.

In step S70 (that is, step F), the trap solution being the trap solvent in which the inhaling flavor component is trapped in step S30, is added to the tobacco residue obtained after being pulverized or cut in step S60. It should be noted that in step S70, an amount of the inhaling flavor component (here, the nicotine component) contained in the tobacco raw material obtained after adding the trap solution to the tobacco residue is equal to or less than an amount of the inhaling flavor component (here, the nicotine component) contained in the tobacco raw material obtained before releasing the inhaling flavor component in step S20.

The method of manufacturing a flavor source according to the embodiment includes a step of adding an acidic substance to the trap solution (that is, step G1), or a step of adding an acidic substance to the tobacco residue obtained after being washed in step S50 (that is, step G2). An example of the acidic substance can include carboxylic acid such as levulinic acid, malic acid, citric acid, tartaric acid, pyruvic acid, or formic acid.

The step of adding these acidic substances may be included in step S70 of adding the trap solution to the tobacco residue. Alternatively, after the acidic substance is added to the trap solution, the trap solution added with the acidic substance may be added to the tobacco residue. In such a case, it is preferable that the acidic substance is added to the trap solution before step S40. Alternatively, after adding the acidic substance toe the tobacco residue obtained after being washed in step S50, the trap solution may be added to the tobacco residue added with the acidic substance. In such a case, it is preferable that the acidic substance is added to the tobacco residue obtained after being pulverized or cut in step S60. Alternatively, after step S70, the acidic substance may be added to the tobacco residue added with the trap solution.

Here, it is preferable that an addition amount of the acidic substance satisfies the following condition. Specifically, the condition is that a ratio of a molar amount of the acidic substance added to the trap solvent, relative to a molar amount of the inhaling flavor component (here, the nicotine component) trapped by the trap solvent (hereinafter, referred to as A/N ratio), is preferably 1.0 or more. The A/N ratio preferably is 1.5 or more, and more preferably is 3.0 or less.

The method of manufacturing a flavor source according to the embodiment may include a water-adding step (that is, step H1) of adding water so that the tobacco residue contains 10 wt % or more of water, where a total weight of a predetermined substance contained in the tobacco residue obtained after being added with the trap solution is 100 wt %. It should be noted that in such a case, "10 wt % or more of water" includes water previously contained in the tobacco residue before the water is added.

Alternatively, the method of manufacturing a flavor source according to the embodiment includes a water-adding step (that is, step H2) of adding water so that the trap solution contains 10 wt % or more of water, where a total weight of a predetermined substance contained in the trap solution obtained before being added to the tobacco residue is 100 wt %. It should be noted that in such a case, "10 wt % or more of water" does not include the water contained in the tobacco residue, but contains the water previously contained in the trap solvent.

In these cases, the predetermined substance is a mixture of an acidic substance, a polyol such as glycerin, and water, a mixture of an acidic substance, an alcohol such as ethanol, and water, or a mixture of an acidic substance, a polyol, an alcohol, and water.

The method of manufacturing a flavor source according to the embodiment may include a step of adding a polyol or an alcohol to any of the trap solution obtained before the inhaling flavor component is trapped in step S30, the trap solvent obtained after the inhaling flavor component is trapped in step S30, and the tobacco residue obtained after being washed in step S50. Alternatively, in step S30, a solvent containing a polyol or an alcohol may be used as a trap solvent before trapping the inhaling flavor component. The polyol or the alcohol is used as an aerosol source from which an aerosol is generated.

Here, the timing at which the above-described water-adding step is performed is not particularly limited. The water-adding step may be performed at the same timing as the step of adding the acidic substance or may be performed at the same timing as the step of adding the polyol or the ethanol. Alternatively, the water-adding step may be performed at the same timing (for example, in step S70) as the step of adding the acidic substance and the step of adding the polyol or the ethanol. Alternatively, the water-adding step may be performed at a different timing from the step of adding the acidic substance and the step of adding the polyol or the ethanol. It is noted that in a case where the water is added to the trap solution, it is preferable that the water-adding step is performed after at least step S40.

The method of manufacturing a flavor source according to the embodiment may include a step of adding a binder to the trap solution (that is, step I1), or a step of adding a binder to the tobacco residue obtained after being washed in step S50 (that is, step I2). The binder is, for example, CMC (carboxymethyl cellulose).

These steps of adding the binder may be included in step S70 of adding the trap solution to the tobacco residue. Alternatively, after the binder is added to the trap solution obtained after the inhaling flavor component is trapped in step S30, the trap solution added with the binder may be added to the tobacco residue. Alternatively, after the binder is added to the tobacco residue obtained after being washed in step S50, the trap solution may be added to the tobacco residue added with the binder. In such a case, a binder may be added to the tobacco residue obtained after being pulverized or cut in step S60. Alternatively, after step S70 is performed, the binder may be added to the tobacco residue added with the trap solution.

It is noted that the above-described water-adding step may be performed simultaneously with the step of adding the binder to the trap solution, or may be performed after the step of adding the binder to the trap solution.

In step S80 (that is, step J), the tobacco residue is formed after step S70 and the addition of the binder. The tobacco residue formed in step S80 contains a plurality of granular bodies. For example, in step S80, the tobacco residue is formed into a plurality of granular bodies by extrusion molding and size regulating treatment.

It is noted that if the tobacco residue added with the trap solution is used as is as the flavor source 130, the process of step S80 may be omitted.

(Operation and Effect)

In the embodiment, when step S20 and step S30 of trapping the inhaling flavor component contained in the tobacco raw material into the trap solvent are performed, and step S70 of adding, to the tobacco residue, the trap solution being the trap solvent with the trapped inhaling flavor component is performed, an impurity such as ammonia can be selectively reduced with an easy and low-cost process.

In the embodiment, when step S50 of washing the tobacco residue with the washing solvent is performed before step S70 of adding the trap solution to the tobacco residue, an impurity component such as TSNA can be further selectively reduced.

In the embodiment, before step S60 of pulverizing or cutting the tobacco residue, step S50 of washing the tobacco residue with the washing solvent is performed. That is, since the size of the tobacco residue in step S50 is relatively large, a reduction in yield of the tobacco residue in step S50 is suppressed. On the other hand, after step S70 of pulverizing or cutting the tobacco residue, step S70 of adding the trap solution to the tobacco residue is performed. That is, since the size of the tobacco residue in step S70 is relatively small, it is possible to uniformly distribute the trap solution on the surface of the tobacco residue.

In the embodiment, step S60 of pulverizing or cutting the tobacco residue obtained after being washed in step S50 is performed. This improves the formability of the tobacco residue in step S80. Even in a case where the process of step S80 is omitted, a delivery efficiency of the inhaling flavor component to the tobacco residue from the trap solution is improved.

In the embodiment, also the particle size of the tobacco residue is greater than at least 1 mm before step S50. As a result, it is possible to reduce the loss of the tobacco residue in step S50. Further, in a process (dehydration treatment) of extracting, together with the washing solvent, a soluble component released from the tobacco residue into the washing solvent, clogging of a filter through which the washing solvent containing the soluble component passes is suppressed.

In the embodiment, the method of manufacturing a flavor source may include a step of adding the acidic substance to the trap solution, or a step of adding the acidic substance to the tobacco residue obtained after being washed in step S50. According to such a configuration, after adding the trap solution to the tobacco residue, a situation where the inhaling flavor component is volatilized again from the tobacco residue is suppressed, and it is possible to maintain the inhaling flavor component carried on the tobacco residue. It is noted that according to the configuration where the acidic substance is added to the trap solution, it is possible to reduce an impurity such as ammonia that can be increased due to neutralization with the acidic substance in step S30.

In the embodiment, it is preferable that the acidic substance is added to the trap solution before step S40. According to such a configuration, it is possible to improve a residual ratio of the inhaling flavor component as compared with a case where the acidic substance is added after step S40.

In the embodiment, it is preferable that the acidic substance is added to the tobacco residue obtained after being pulverized or cut in step S60. With such a configuration, corrosion and the like of the pulverizer or the cutting machine can be suppressed. Further, if step S60 and step S70 are performed at different places or with different devices, the loss of acidic substance in step S60 can be reduced.

In the embodiment, the method of manufacturing the flavor source may include a water-adding step of adding water so that the tobacco residue (or the trap solution) contains water of 10 wt % or more, where a total weight of the aforementioned predetermined substance contained in the tobacco residue (or the trap solution obtained before being added to the tobacco residue) obtained after being added with the trap solution is 100 wt %. According to such a configuration, in the process after step S70, liquid denaturation such as generation of an excessive substance due to, for example, esterification of the acidic substance caused by a reaction between a component contained in the trap solution or the tobacco residue and the acidic substance is suppressed, and thus, a residual ratio of the acidic substance added to the trap solution or the tobacco residue is improved.

[First Modification]

A first modification of the embodiment will be described, below. A difference from the embodiment will be mainly described, below.

Specifically, in the embodiment, when the inhaling flavor component released into the vapor phase is trapped by the trap solvent 70 by heating the tobacco raw material 50, the inhaling flavor component is collected. On the other hand, in the first modification, when the inhaling flavor component released into the vapor phase by heating the tobacco raw material 50 is condensed, the inhaling flavor component is collected. In the first modification, the inhaling flavor component is collected by condensing the inhaling flavor component, and thus, the inhaling flavor component released into the vapor phase is collected as a liquid phase as in the embodiment. In the following, cooling of the inhaling flavor component will be described as an example of the condensation method.

Figure 5:
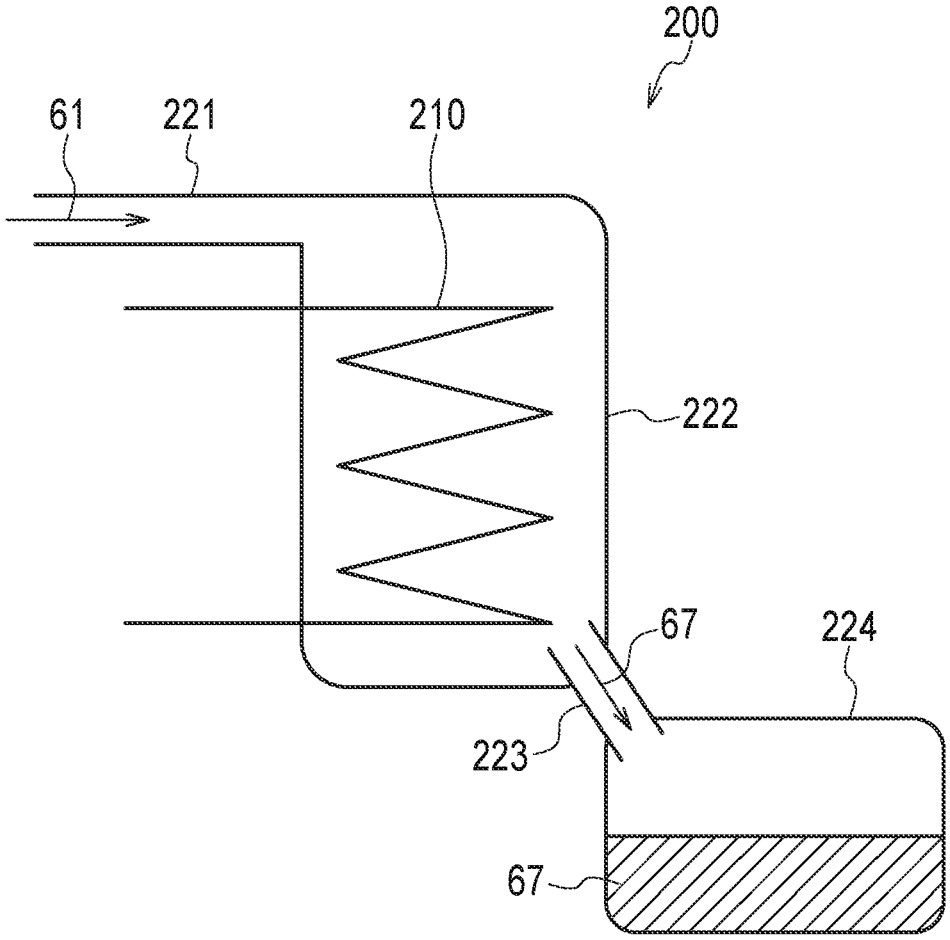
FIG. 5 is a diagram illustrating an example of a manufacturing device according to a first modification.

In particular, in the first modification, instead of the trap device 20 illustrated in FIG. 2, a collection device 200 illustrated in FIG. 5 is used. As illustrated in FIG. 5, the collection device 200 includes a condenser 210, a pipe 221, a cooling chamber 222, a pipe 223, and a collection chamber 224.

The pipe 221 guides the released component 61 released into the vapor phase by heating the tobacco raw material 50 toward the cooling chamber 222. The cooling chamber 222 houses the condenser 210, and the condenser 210 condenses the released component 61 by cooling of the released component 61. Although not particularly limited, the condenser 210 may be configured of a condenser. The pipe 223 guides a condensed component 67 being the released component 61 condensed by the condenser 210, to the collection chamber 224. The condensed component 67 contains at least the nicotine component being an indicator of the inhaling flavor component. The collection chamber 224 retains the condensed component 67. It is noted that the released component 61 is a vapor component and the condensed component 67 is a liquid component. Here, the condensed component 67 is an inhaling flavor solution containing the inhaling flavor component.

In first modification, as in the embodiment, before the tobacco residue is pulverized or cut, the washing step of the tobacco residue is performed. According to such a configuration, a reduction in yield of the tobacco residue in the washing step is suppressed.

In the first modification, as in the embodiment, the condensed component 67 (inhaling flavor component) collected by the collection device 200 is added to the tobacco residue obtained after being pulverized or cut, as in the embodiment. According to such a configuration, it is possible to uniformly distribute the trap solution on a surface of the tobacco residue.

Also in first modification, as in the embodiment, the acidic substance may be added to the condensed component 67 (step G1). Also in the first modification, as in the embodiment, polyol or alcohol may be added to the condensed component 67. In first modification, as in the embodiment, the water may be added so that the condensed component 67 contains 10 wt % or more of water (step H2). In first modification, as in the embodiment, the binder may be added to the condensed component 67 (step I1).

EXPERIMENTAL RESULT

First Experiment

In a first experiment, the flavor source manufacturing method described above (see FIG. 4) was simulated so that samples 21-24 were manufactured, as the trap solution at a stage subsequent to step S40, by mixing nicotine (CAS: 54-11-5, purity: 99.5%) and other reagents. That is, for the sample 21 to the sample 24, glycerol was used as the trap solvent. The amount of glycerol in the sample 21 was approximately 70 wt %, and the amount of glycerol in the samples 22 to 24 was approximately 90 wt %, where the trap solution equals 100 wt %. In the samples 22-24, an acidic substance (here, levulinic acid) was added to the trap solvent. It is noted that the water in the sample 21 to the sample 24 was less than 1 wt %, where a predetermined substance (mixture of acidic substance, glycerin, and water) contained in the trap solution was 100 wt %. As illustrated in FIG. 6, A/N ratios in the samples 22 to 24 were 0.53, 1.16, and 3.52, respectively. Note that, as mentioned above, the A/N ratio is the ratio of the molar amount of the acidic substance (here, levulinic acid) added to the trap solvent, to the molar quantity of the inhaling flavor component (here, the nicotine component) trapped by the trap solvent.

Figure 7:
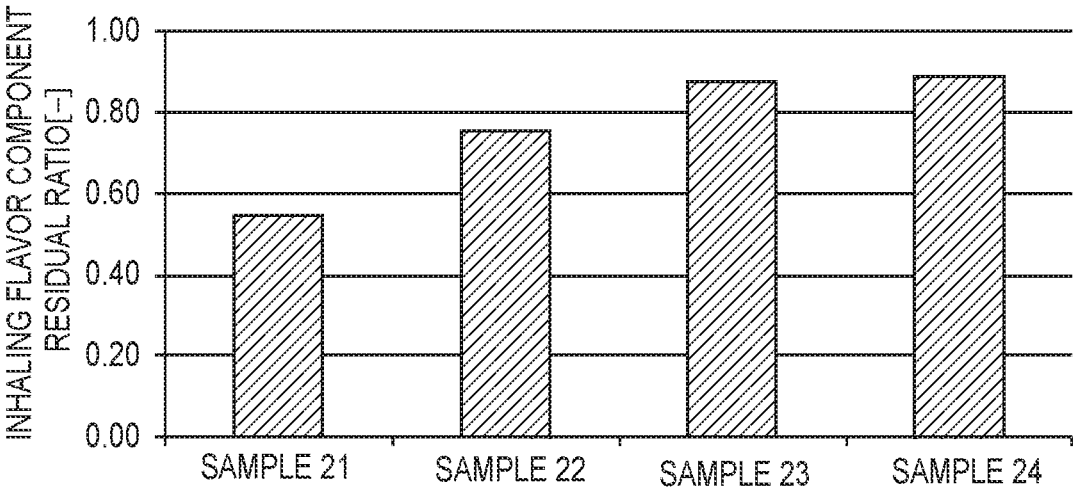
FIG. 7 is a diagram for explaining the first experiment.
Figure 8:
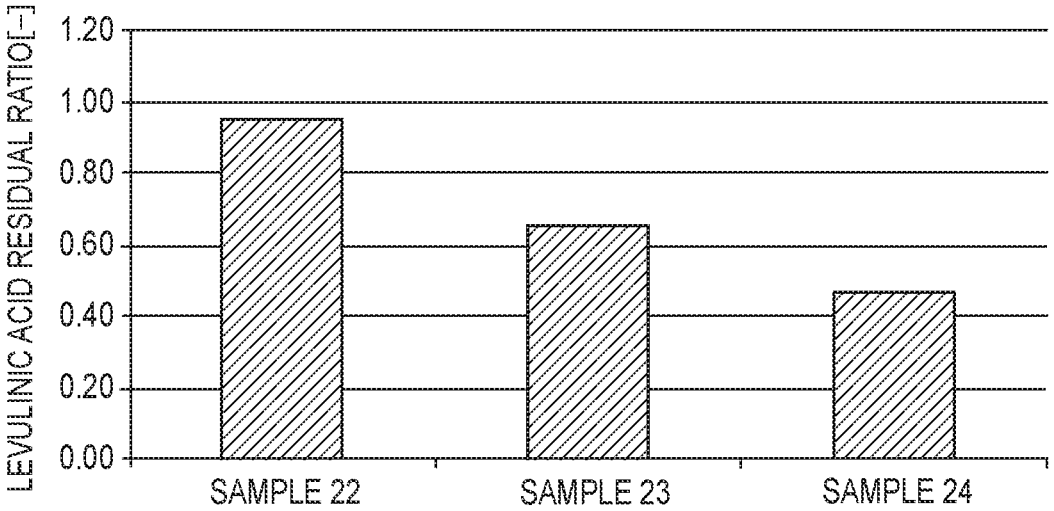
FIG. 8 is a diagram for explaining the first experiment.

In the first experiment, as a conditioning process after step S40, conditioning was carried out under open space conditions for seven days, in an environment controlled to 40° C. For the samples 21-24, the ratio of the amount of the inhaling flavor component (here, the amount of the nicotine component) after carrying out conditioning under open space conditions to the amount of the inhaling flavor component (here, the amount of the nicotine component) prior to carrying out conditioning under open space conditions (the inhaling flavor component residual ratio) was measured. The measurement results were as illustrated in FIG. 6 and FIG. 7. For the samples 22-24, the ratio of the amount of levulinic acid after carrying out conditioning under open space conditions to the amount of levulinic acid prior to carrying out conditioning under open space conditions (the levulinic acid residual ratio) was measured. The measurement results were as illustrated in FIG. 6 and FIG. 8.

Here, in the first experiment, the inhaling flavor component residual ratio was determined to be sufficient when the inhaling flavor component residual ratio was 0.8 or greater, and the levulinic acid residual ratio was determined to be sufficient when the levulinic acid residual ratio was 0.8 or greater.

As illustrated FIG. 7, it was found that the inhaling flavor component residual ratio of the samples 22-24 which contained levulinic acid was higher than that of the sample 21, which did not contain levulinic acid. In detail, for the samples 23 and 24, which had A/N ratios of 1.0 or greater, the inhaling flavor component residual ratio exceeded 0.8, and the inhaling flavor component residual ratio was found to be sufficient; whereas, for the sample 22, which had an A/N ratio of substantially 0.5 or less, the inhaling flavor component residual ratio fell below 0.8, and the inhaling flavor component residual ratio was found to be insufficient. Meanwhile, as illustrated in FIG. 8, it was found that the levulinic acid residual ratio declines at higher A/N ratios. In particular, it was confirmed that the levulinic acid residual ratio of the samples 23 and 24 having an A/N ratio of 1.0 or more was lower than 0.8, and the levulinic acid residual ratio was insufficient.

That is, it was confirmed that if the A/N ratio was 1.0 or more, the inhaling flavor component residual ratio was sufficient. However, the levulinic acid residual ratio was insufficient.

Second Experiment

In a second experiment, the flavor source manufacturing method described above (see FIG. 4) was simulated so that samples 41-44 were manufactured, as the trap solution at a stage subsequent to step S40, by mixing nicotine (CAS: 54-11-5, purity: 99.5%) and other reagents. For the sample 41 to the sample 44, glycerin was used as a trap solvent. The amount of glycerol in the sample 41 and the sample 43 was approximately 80 wt %, and the amount of glycerol in the sample 42 and the sample 44 was approximately 90 wt %, where the trap solution equals 100 wt %. Further, in the sample 41 to the sample 44, the acidic substance (here, levulinic acid) was added to the trap solvent. As illustrated in FIG. 9, the A/N ratios of the samples 41 to 43 are 2.99, 2.98, 1.56, and 1.62, respectively. It should be noted that the samples 41 to 44 are samples having an A/N ratio of 1.0 or more. Here, in the sample 41 and the sample 43, 10 wt % of water was added to the trap solution, where the total weight of a predetermined substance (mixture of acidic substance, glycerin, and water) contained in the trap solution was 100 wt %.

In the second experiment, as the conditioning process after step S40, conditioning was performed under sealed space conditions for four weeks, in an environment controlled to 40° C. For the samples 41 to 44, the ratio of the amount of levulinic acid after carrying out conditioning under sealed space conditions to the amount of levulinic acid prior to carrying out conditioning under sealed space conditions (the levulinic acid residual ratio) was measured. The measurement result is as illustrated in FIG. 9 and FIG. 10.

In the second experiment, if the levulinic acid residual ratio was 0.8 or greater, the levulinic acid residual ratio was determined to be sufficient.

Figure 10:
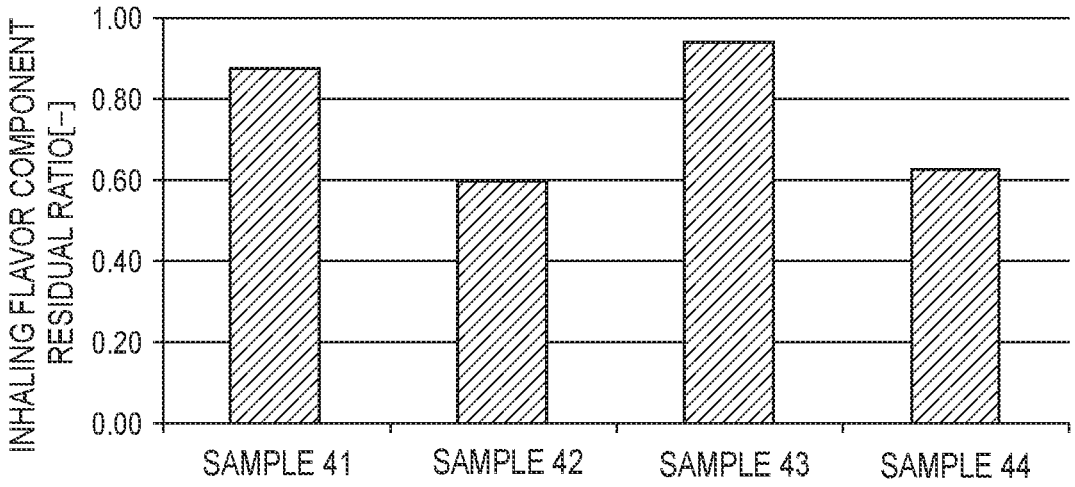
FIG. 10 is a diagram for explaining the second experiment.

As illustrated in FIG. 10, in the sample 41 and the sample 43 in which 10 wt % of water was added to the trap solvent, the levulinic acid residual ratio exceeded 0.8, and the levulinic acid residual ratio was found to be sufficient, whereas in the sample 42 and the sample 44 to which no water was added, the levulinic acid residual ratio fell below 0.8, and the levulinic acid residual ratio was found to be insufficient. That is, in the first experiment, samples in which the A/N ratio was 1.0 or greater were found to have a levulinic acid residual ratio that was insufficient, but for such samples, it was found that the levulinic acid residual ratio was improved by the addition of 10 wt % or more of water. From the results of the first experiment, it should be noted that cases in which the A/N ratio is 1.0 or greater, the inhaling flavor component residual ratio is sufficient.

In this way, it was found that in a case where the A/N ratio is 1.0 or greater, by including 10 wt % or more of water into the trap solution, where the total weight of a predetermined substance (mixture of acidic substance, glycerin and water) contained in the trap solution equals 100 wt %, the levulinic acid residual ratio can be improved, while maintaining the inhaling flavor component residual ratio at a sufficient level.

Here, it is presumed that the decrease in the levulinic acid residual ratio causes the generation of extra substances, due to such as the esterification of levulinic acid caused by the reaction between the levulinic acid and the glycerin. That is, according to the result of the second experiment, it is presumed that when the trap solution contains 10 wt % or more of water, where a predetermined substance contained in the trap solution (mixture of acidic substance, glycerin, and water) equals 100 wt %, the generation of the excessive substances is suppressed.

In the experimental results described above, the trap solution containing the predetermined substance (mixture of acidic substance, glycerin, and water) is discussed, and also in the tobacco residue obtained after the trap solution has been added, the same interaction among the acidic substance, the glycerin, and the water is considered to be obtained, and thus, it is presumed that the generation of the excessive substances is suppressed.

OTHER EMBODIMENTS

The present invention has been described according to the embodiment set forth above; however, the invention should not be understood to be limited by the statements and the drawings constituting a part of this disclosure. From this disclosure, various alternative embodiments, examples, and operational technologies will become apparent to those skilled in the art.

In the embodiment, step S60 is a step of pulverizing the tobacco residue obtained after being washed in step S50 to a particle size of 1 mm or less by a pulverizer. However, the embodiment is not limited thereto.

Specifically, step S60 may include a step of forming the tobacco residue obtained after being washed in step S50 into a sheet shape or a block shape, and cutting the tobacco residue in a sheet shape or a block shape into a cut width of 2 mm or less by a cutting machine. Step S60 is preferably a step of cutting the tobacco residue to a cut width of 1.5 mm or less, more preferably a step of cutting the tobacco residue to a cut width of 1.0 mm or less. Step S60 may include a step of cutting the tobacco residue of a sheet shape or a block shape to a cut length of 3 mm or more and 20 mm or less with a cutting machine. Step S60 is preferably a step of cutting the tobacco residue to a cut length of 5 mm or more and 15 mm or less.

INDUSTRIAL APPLICABILITY

According to the present disclosure, it is possible to provide a method of manufacturing a flavor source with which it is possible to suppress a decrease in yield of a tobacco residue in a washing treatment and uniformly distribute a trap solution in a tobacco raw material obtained after the trap solution is added.

The invention claimed is:

1. A manufacturing method comprising:

a step A of adding a basic substance to a tobacco raw material;

a step B of heating the tobacco raw material added with the basic substance and releasing an inhaling flavor component into a vapor phase from the tobacco raw material;

a step C of collecting the inhaling flavor component released into the vapor phase in the step B;

a step D of washing a tobacco residue being the tobacco raw material obtained after the inhaling flavor component is released in the step B, with a washing solvent, wherein before the step D, the particle size of the tobacco residue is larger than 1 mm;

a step E of pulverizing the tobacco residue obtained after being washed in the step D to a particle size of 1 mm or less;

a step F of adding the inhaling flavor component collected in the step C to the tobacco residue obtained after being pulverized or cut in the step E;

at least one of step G1 or step G2:

a step G1 of adding an acidic substance to an inhaling flavor solution containing the inhaling flavor component collected in step C;

a step G2 of adding an acidic substance to the tobacco residue obtained after being washed in step D; and a step H2 of adding water so that the inhaling flavor solution contains 10 wt% or more of water, wherein before being added to the tobacco residue in step F, a total weight of a predetermined substance contained in the inhaling flavor solution containing the inhaling flavor component collected in step C is 1.0 wt % or more and 3.0 wt % or less;

wherein the predetermined substance is a mixture of the acidic substance, a polyol, and water, a mixture of the acidic substance, an alcohol, and water, or a mixture of the acidic substance, a polyol, an alcohol, and water;

wherein step C is a step of collecting, as a liquid phase, the inhaling flavor component released into a vapor phase in the step; and wherein a ratio of a molar amount of the acidic substance relative to a molar amount of the inhaling flavor component collected in step C is 1.0 or more and 3.0 or less.

2. The manufacturing method according to claim 1, wherein the step D is a step of supplying the washing solvent to the tobacco residue and extracting, together with the washing solvent, a soluble component released into the washing solvent from the tobacco residue.

3. The manufacturing method according to claim 2, wherein the step D is repeated at least twice or more.

4. The manufacturing method according to claim 3, wherein the step D is repeated at least twice or more by using the washing solvents having temperatures different from each other.

5. The manufacturing method according to claim 4, wherein the step D includes a step of performing bubbling while adding $CO_2$ gas to the washing solvent having a lowest temperature or the washing solvent having a temperature of 20° C. or less, from among the washing solvents having the temperatures different from each other.

6. The manufacturing method according to claim 1, wherein the step D comprises:

a step of extracting the soluble component by using water having a first temperature as the washing solvent; and a step of extracting the soluble component by using water having a second temperature lower than the first temperature as the washing solvent and performing bubbling while adding $CO_2$ gas to the water having the second temperature.

7. The manufacturing method according to claim 1, wherein the step C includes a step of condensing the inhaling flavor component released into a vapor phase in the step B.

8. The manufacturing method according to claim 1, wherein the step C includes a step of trapping the inhaling flavor component released into a vapor phase in the step B, by a trap solvent.

9. The manufacturing method according to claim 1, wherein the step G2 is performed after the step E.

10. The manufacturing method according to claim 1, comprising:

a step of adding a polyol or an alcohol to at least one of a trap solvent for trapping the inhaling flavor component, an inhaling flavor solution containing the inhaling flavor component collected in the step C, and the tobacco residue.

11. The manufacturing method according to claim 8, wherein in the step C, a solvent containing a polyol or an alcohol is used as the trap solvent.

12. The manufacturing method according to claim 1, comprising:

a step H1 of adding water so that the tobacco residue contains 10 wt % or more of water, where a total weight of a predetermined substance contained in the tobacco residue obtained after the inhaling flavor component is added in the step F is 100 wt %, wherein the predetermined substance is a mixture of the acidic substance, a polyol, and water, a mixture of the acidic substance, an alcohol, and water, or a mixture of the acidic substance, a polyol, an alcohol, and water.

13. The manufacturing method according to claim 1, comprising:

a step I1 of adding a binder to an inhaling flavor solution containing the inhaling flavor component collected in the step C; or a step I2 of adding a binder to the tobacco residue obtained after being washed in the step D.

14. The manufacturing method according to claim 13, comprising:

a step J of forming the tobacco residue after the step F and addition of the binder.

15. The manufacturing method according to claim 14, wherein the tobacco residue formed in the step J comprises a plurality of granular bodies.

16. The manufacturing method according to claim 1, wherein at least any one of the step A and the step B includes a step of adding water to the tobacco raw material.

* * * * *